US009551127B1

(12) United States Patent
Gochis

(10) Patent No.: US 9,551,127 B1
(45) Date of Patent: Jan. 24, 2017

(54) ROTARY DRIVE TIP SYSTEM FOR INSTALLATION OF PILES OR OTHER FOUNDATION MEMBERS INTO THE GROUND

(71) Applicant: Bernard J. Gochis, Westminster, CO (US)

(72) Inventor: Bernard J. Gochis, Westminster, CO (US)

( * ) Notice: Subject to any disclaimer, the term of this patent is extended or adjusted under 35 U.S.C. 154(b) by 0 days.

(21) Appl. No.: 14/754,168

(22) Filed: Jun. 29, 2015

Related U.S. Application Data

(62) Division of application No. 13/532,623, filed on Jun. 25, 2012, now Pat. No. 9,068,318.

(60) Provisional application No. 61/500,487, filed on Jun. 23, 2011.

(51) Int. Cl.

| | |
|---|---|
| ***E02D 5/56*** | (2006.01) |
| ***E02D 5/28*** | (2006.01) |
| ***E02D 5/80*** | (2006.01) |
| ***E02D 7/22*** | (2006.01) |
| ***E02D 5/52*** | (2006.01) |

(52) U.S. Cl.
CPC . *E02D 5/56* (2013.01); *E02D 5/28* (2013.01); *E02D 5/526* (2013.01); *E02D 5/801* (2013.01); *E02D 7/22* (2013.01)

(58) Field of Classification Search
CPC ..... E02D 5/06; E02D 5/54; E02D 7/28
See application file for complete search history.

(56) References Cited

U.S. PATENT DOCUMENTS

| | | | | |
|---|---|---|---|---|
| 4,614,462 | A | 9/1986 | Itou | |
| 4,688,969 | A | 8/1987 | Bruser et al. | |
| 5,934,836 | A | 8/1999 | Rupiper et al. | |
| 6,881,014 | B2 | 4/2005 | Saeki et al. | |
| 7,416,367 | B2 | 8/2008 | St. Onge et al. | |
| 7,510,350 | B2 * | 3/2009 | Ronnkvist | E02D 5/801 405/231 |
| 7,635,240 | B2 * | 12/2009 | Gantt, Jr. | E02D 5/801 405/252.1 |
| 7,731,454 | B1 | 6/2010 | Watson, III et al. | |
| 9,068,318 | B1 * | 6/2015 | Gochis | E02D 5/56 |
| 2002/0081158 | A1 | 6/2002 | Strong et al. | |
| 2004/0076479 | A1 | 4/2004 | Camilleri | |
| 2005/0074298 | A1 | 4/2005 | Jones | |
| 2009/0116910 | A1 | 5/2009 | Whitsett | |

* cited by examiner

*Primary Examiner* — Benjamin Fiorello
(74) *Attorney, Agent, or Firm* — James A. Sheridan; Sheridan Law, LLC

(57) ABSTRACT

For supporting a foundation of other structure, there is provided a system for driving a pile into the ground using a rotary power device. In one example, a system includes a first member with a first end connecting to a drill and a second end having a keyed protrusion; and a second member having a hollow pile adapted to receive the first member therein, one or more blades along a perimeter of a lower portion, and a keyed opening for receiving the keyed protrusion. In use, a drill is connected with the first member, and the first member is inserted into the second member, and the drill drives the first member into and through the ground. The drill and the first member are removed, leaving the second member positioned into the ground at its desired depth.

11 Claims, 7 Drawing Sheets

ROTARY DRIVE TIP SYSTEM FOR INSTALLATION OF PILES OR OTHER FOUNDATION MEMBERS INTO THE GROUND

CROSS REFERENCE TO RELATED APPLICATION

This application is a division of pending prior U.S. patent application Ser. No. 13/532,623, filed Jun. 25, 2012 by Bernard J. Gochis for ROTARY DRIVE TIP SYSTEM FOR INSTALLATION OF PILES OR OTHER FOUNDATION MEMBERS INTO THE GROUND, which claims priority under 35 U.S.C. §119(e) to U.S. Provisional Patent Application No. 61/500,487 filed Jun. 23, 2011 entitled "Rotary Drive Tip System For Installation Of Piles Or Other Foundation Members Into The Ground" the disclosure of which is hereby incorporated by reference in its entirety.

FIELD OF THE INVENTION

This invention relates, in general, to driving structural members such as piles into the ground, to support foundations.

BACKGROUND OF THE INVENTION

Structural foundations have often been formed using concrete for the foundation. However, foundations may also be formed without the use of concrete. Foundations for structures such as buildings, platforms, or other structures can be formed using a foundation base connected with piles or other structural members that are driven into the ground.

One problem that arises when attempting to install a pile-type foundation is where the ground is stiff, rocky, cobbly, solid rock, or even the soft muck type of a geotechnical subsurface. In such difficult environments, it can be challenging to install conventional piles into the ground, and as recognized by the present inventor, a pile can be damaged during installation if it is driven from the top.

As recognized by the present inventor, what is needed is a system of piles or other foundation members that can be installed into the ground, including into rock or other surfaces.

SUMMARY

In light of the above and according to one broad aspect of one embodiment of the present invention, disclosed herein is a system for driving a foundational pile into the ground using a drill or other rotary power device. In one example, the system includes a first member having a first end and a second end, the first end connecting to the drill, the second end having a keyed protrusion; and a second member having an upper portion that includes a hollow pile adapted to receive the first member therein, and a lower portion that includes one or more blades along a perimeter of the lower portion, the second member having a keyed opening for receiving the keyed protrusion of the first member.

In use, the drill or power rotary device is connected with the first member, and the first member is inserted into the second member, and the drill is activated to drive the first member connected to the lower portion of the second member into and through the ground. The drill and the first member can then be removed, leaving the second member positioned into the ground at its desired depth.

The first member may have one or more centering rings positioned about its perimeter, and may be steel or other metal. The first member is removably attachable to the drill, in one example. The keyed protrusion of the first member may be hexagonal in shape, or other shapes. In one example, the hollow pile of the second member is adapted to be secured to the foundation. The lower portion of the second member may be made of steel or other metal, and the blades of the lower portion may be helical.

In one example, the keyed opening is positioned about an upper region of the lower portion of the second member, or in another example, the keyed opening is positioned about a lower region of the lower portion of the second member.

According to another broad aspect of another embodiment of the present invention, disclosed herein is a system for supporting a pile member in the ground. In one example, the system includes a first member having a first end and a second end, the first end connecting to a drill, the second end having a keyed protrusion; and a second member adapted to be drilled into the ground, the second member having a hollow upper portion adapted to receive the first member therein, and a lower portion that includes one or more blades along a perimeter of the lower portion, the second member having a plate defining a keyed opening for receiving the keyed protrusion of the first member; wherein the second member is adapted to be connected with the pile member.

According to another broad aspect of another embodiment of the present invention, disclosed herein are various methods for drilling a foundation support member into the ground. In one example, the method may include providing a drill; providing a first member having a first end and a second end, the first end adapted to be connected with the drill, the second end having a keyed protrusion; providing a second member having an upper portion that includes a hollow pile adapted to receive the first member therein, and a lower portion that includes one or more blades along a perimeter of the lower portion, the second member having a keyed opening for receiving the keyed protrusion of the first member; connecting the drill to a first end of a first member; positioning the second member in place relative to the ground; inserting the first member into the second member so that the keyed protrusion of the first member mates with the keyed opening of the second member; and operating the drill so as to rotate the first member and the second member until a portion of the second member is drilled into the ground. The top portion of the second member may then be connected to a portion of the foundation that is to be supported.

The features, utilities and advantages of the various embodiments of the invention will be apparent from the following more particular description of embodiments of the invention as illustrated in the accompanying drawings.

3, with various pile members later attached thereto, in accordance with one embodiment of the present invention.

Figure 6:
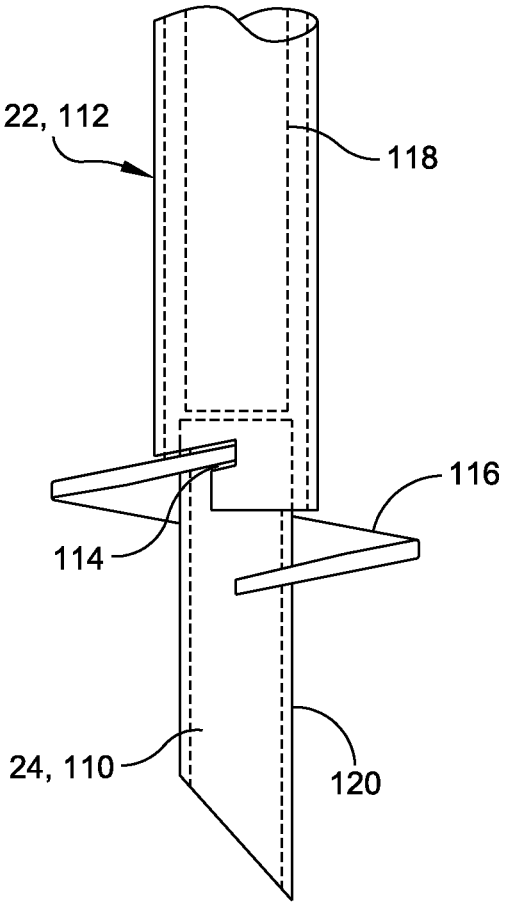

FIG. 6 illustrates another embodiment, wherein a rotary drive tip pile member is driven externally, in accordance with another embodiment of the present invention.

DETAILED DESCRIPTION

Disclosed herein is a system, components and associated methods for installing piles or other foundation members into the ground. According to one embodiment of the present invention, the system may be implemented as at least a two-piece system 20, including a first removable drive extension member 22; and a second rotary drive tip pile member 24, which is adapted to be driven into the ground. During use, the drive extension member 22 is adapted to fit inside of a portion of the rotary drive tip pile member 24, so that it can be used to drive the rotary drive tip pile member 24 into the ground.

Figure 1:
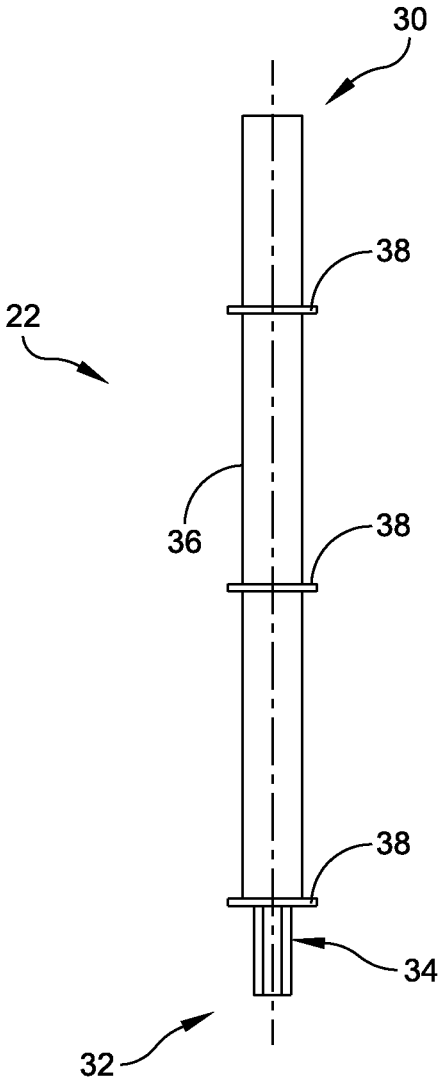
FIG. 1 illustrates a removable drive extension member, in accordance with one embodiment of the present invention.
Figure 4:
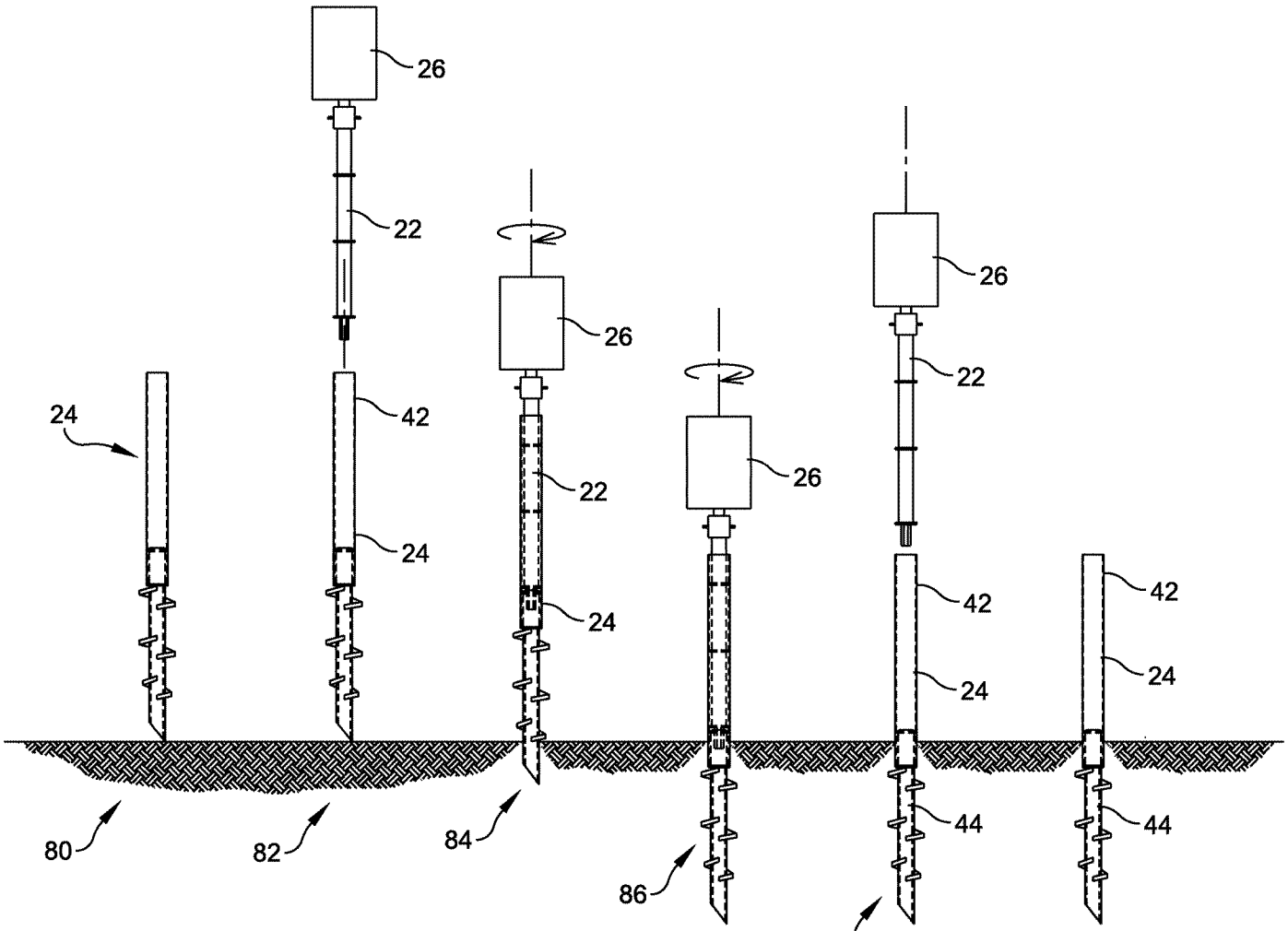
FIG. 4 illustrates an example of a sequence of operations for installing the rotary drive tip pile member of FIG. 2, in accordance with one embodiment of the present invention.

Referring to FIG. 1, a removable drive extension member 22 is adapted to be connected on its upper end 30 to a rotary power source such as a hydraulic drill or other conventional power source 26 (shown in FIGS. 4-5). On its lower end 32, the drive extension member 22 has a keyed protrusion 34 which acts as a drive key and is adapted to mate with and engage a corresponding part of the rotary drive tip pile member 24 (see FIGS. 4-5). The drive extension member 22 includes in one example a cylindrical shaft 36 having one or more centering rings 38 positioned about the perimeter of the shaft 36. These centering rings 38 help position and center the drive extension member 22 within the interior of the hollow shaft of the rotary drive tip pile member 24, as described below.

The drive extension member 22 is preferably made of a rigid material such as steel or other metal, which is capable of withstanding torque or rotational forces as the drill or other power source rotates the drive extension member 22, which is coupled with the rotary drive tip pile member 24, as the rotary drive tip pile member 24 is driven into the ground. In this sense, during use the drive extension member 22 transfers rotary power, from the drill or other power source 26, directly to the rotary drive tip pile member 24.

At the lower end 32 of the drive extension member 22, the protrusion or drive key 34 is adapted to removably engage and mate with a corresponding part (shown as drive key plate 40 in FIG. 2) within the shaft of the rotary drive tip pile member 24. In the examples shown in FIGS. 1-3, the drive key 34 is shown as a hexagon shape, however, other shapes or forms of drive keys 34 may be used depending upon the particular implementation.

At the upper end 30 of the drive extension member 22, any standard or conventional connection can be provided in order to couple the top end 30 of the drive extension member 22 to a rotary power source 26 such as a hydraulic drill or other conventional power source.

The drive extension 22 could be a solid member, or hollow if desired, and can be formed from steel or metal or other rigid material.

Figure 2A:
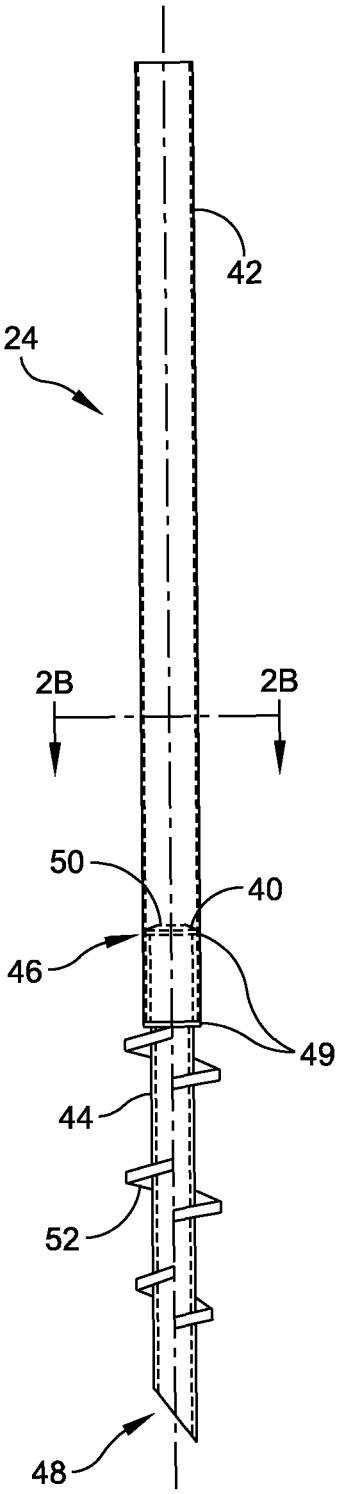
FIGS. 2*a-b* illustrate a rotary drive tip pile member, in accordance with one embodiment of the present invention.
Figure 2B:
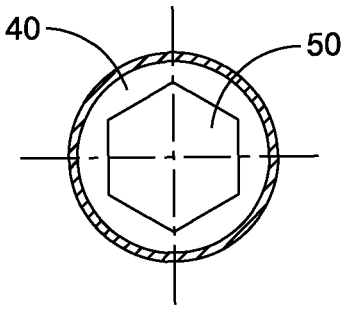

Referring to FIGS. 2*a-b*, one example of a rotary drive tip pile member 24 is illustrated. In this example, the pile member 24 has an upper pile shaft 42 coupled with or integral with a lower driving shaft 44.

The upper pile shaft 42 is adapted to be above the grade once the pile member 24 has been driven into the ground. After installation into the ground, the upper pile shaft 42 is adapted to be connected through conventional attachment mechanisms with 9 foundation (or portion thereof), foundational platform or other structural members. The pile members 24 may be attached to foundation structures or intermediary structures using conventional techniques such as welding, bolts, screws, mechanical locks, direct mounts, concrete mediums or the like.

As shown in FIGS. 2-4, the upper pile shaft 42 may be generally cylindrical and hollow, and is adapted to house within its hollow shaft, the removable drive extension member 22. Hence, the inner diameter of the upper pile shaft 42 is larger that the outer diameter of the removable drive extension member 22. The centering rings 38 that are attached to the perimeter of the shaft 36 of the drive extension 22 are sized so as to fit within the inner diameter of the upper pile shaft 42.

The upper pile shaft 42 can be made of various materials, including rigid materials, such as metal, carbon fiber, PVC, or other materials. The upper pile shaft 42 is connected with or integral with the lower driving shaft 44, for instance, the upper pile shaft 42 is welded to the lower drive shaft 44. The upper pile shaft 42 may be connected with the lower drive shaft 44 using mechanical interlocks, bolts, grouted, welds, or other connection techniques. When forming rotary drive tip pile member 24, one or more centering rings 49 (with an outside diameter smaller than the inside diameter of the upper pile shaft 42) may be welded about the top end of the lower driving shaft 44 so as to align the center lines or axis of the lower driving shaft 44 and the upper pile shaft 42 when they are connected (e.g., welded) together.

Depending upon the particular implementation, the upper pile shaft 42 can be formed and manufactured to satisfy the above-grade requirements for the foundation system, which may include load-bearing conditions, or coupling requirements with the item(s) being supported by the upper pile shaft 42.

The lower driving shaft 44 of the rotary drive tip pile member 24 has an upper end 46 and a lower end 48. The upper end 46 includes a drive key plate or other structure 40 which receives or mates with the lower end or keyed protrusion 34 of the drive extension member 22. In one example, the drive key plate 40 defines an opening 50 with a keyed perimeter to receive the keyed protrusion 34 of the drive extension member 22. That keyed opening pattern 50 shown in FIG. 1-2 is hexagonal, however, it is understood that any other shape or pattern could be utilized to form keyed opening 50 depending upon the particular implementation.

In this manner, during use, the drive extension member 22 is inserted into the upper pile shaft 42 and connects with the lower drive shaft 44 via protrusion 34 mating with drive plate 40—so that when the rotary power source 26 (being connected with extension member 22) is activated, the rotational force is transferred from rotary power source 26 through the drive extension member 22 to the lower driving shaft 44 of the pile member 24, thereby rotating the lower driving shaft 44. In this way, the lower driving shaft 44 receives the torque/torsional forces as the rotary drive tip pile 24 is drilled into the ground, and the upper pile shaft 42 is not exposed to such torsional forces, which thereby protects the upper pile shaft 42 from stress or damage. In effect, the upper pile shaft 42 is not driven from its top, which helps to maintain the structural integrity of the upper pile shaft 42.

The lower driving shaft 44 can be solid, hollow, or can have hollow portions, and can be formed of metal, such as steel or other rigid materials. The lower driving shaft 44 can have wall thicknesses that are adapted for corrosion requirements, for instance where thicker walls may be required. The lower driving shaft 44 may be formed with or without the blade(s) 52 (i.e., helical blades), depending upon the implementation.

Along the perimeter of the driving shaft 44, one or more blades 52, such as helix blades, may be provided in order to cut through the ground and subsurface while the lower driving shaft 44 is being driven into the ground. In one example, at the lower end 48 of the driving shaft 44, an angled tip 54 may be provided, although any conventional tip or tip shape may be used depending upon the particular implementation.

Figure 3A:
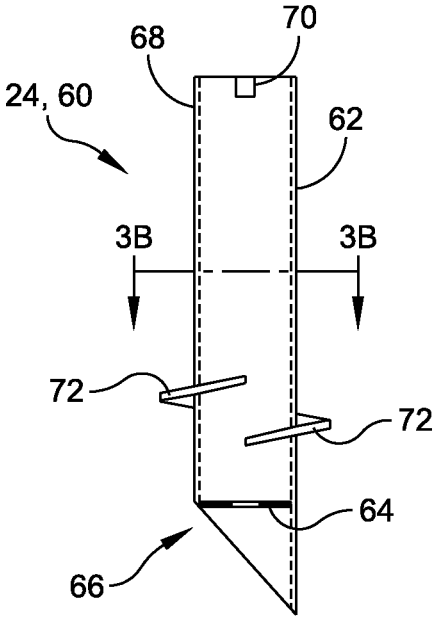
FIGS. 3*a-b* illustrate another example of a rotary drive tip pile member, in accordance with one embodiment of the present invention.
Figure 3B:
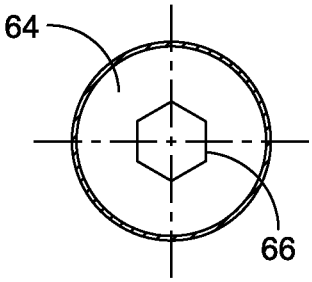

FIGS. 3*a-b* illustrate another example of a rotary drive tip pile member 24, shown as 60. In this example, the rotary tip pile member 60 may have a large diameter, such as 12 inch diameter for example, and has a driving shaft 62 that is hollow, and a drive key plate 64, secured within the hollow shaft 62 towards the lower end 66 of the driving shaft 62, that defines a keyed opening 66. The keyed opening 66 is adapted to receive and mate with the keyed protrusion 34 of the drive extension member 22.

The top end 68 of the driving shaft 62 may be provided with a notch or other keyed shape 70 along the upper rim in order to provide for later alignment of a pile member with respect to the driving shaft 62.

The driving shaft 62 may also include one or more blades 72, such as helix blades, to cut through the ground and subsurface while the driving shaft 62 is being driven into the ground.

During use, the drive extension member 22 is inserted into the driving shaft 62 and connects with the keyed opening 66 through mating of protrusion 34 with plate 64—so that when the rotary power source 26 is activated, the rotational force is transferred from rotary power source 26 through the drive extension member 22 to the driving shaft 62, thereby rotating the driving shaft 62. Once inserted into its desired position within the ground, the member 60/driving shaft 62 can be used to receive a pile or other structural member to support a foundation or platform or other structure—which can be inserted into the interior of the driving shaft 62, be grouted into place, bolted or screwed into place (i.e., through the use of set screws or base plates); or welded to a cap plate that can be secured to the top of the driving shaft 62.

FIGS. 4-5 illustrate examples of methods for installing pile members or other structural members into the ground, in accordance with some embodiments of the present invention.

FIG. 4 illustrates an example of a sequence of operations for installing a rotary drive tip pile member 24 such as shown in FIG. 2, in accordance with one embodiment of the present invention. In FIG. 4, at operation 80, the rotary drive tip pile member 24 is aligned and positioned into place into the desired location, which may have previously been determined by surveying or other conventional techniques. Having aligned and positioned the rotary drive tip pile member 24, at operation 82 the removable drive extension member 22, having a rotary power source 26 such as a hydraulic drill attached thereto, is inserted within the upper portion 42 of the rotary drive tip pile member 24. The drive extension member 22 is keyed or secured into place within the rotary drive tip pile member 24.

At operation 84, the rotary power source 26 is activated, thereby imparting rotational force on to the drive extension member 22, which by virtue of the keyed connection between the drive extension member 22 and the rotary drive tip pile member 24, transfers that rotational force to the lower portion 44 of the rotary drive tip pile member 24, thereby causing the rotary drive tip pile member 24 to rotate and penetrate the ground surface and be driven into the subsurfaces of the ground.

At operation 86, the rotational power source 26 is continued to be applied until the rotary drive tip pile member 24 has been driven into the ground to the desired depth.

At operation 88, the rotational power source 26 is disabled and is vertically removed, along with the drive extension member 22, from the interior of the rotary drive tip pile member 24. Therefore, the rotary drive tip pile member 24 is now secured into the ground at its desired location and depth, with the upper portion 42 of the rotary drive tip pile member 24 being above grade and ready to receive or support a foundation, platform, or other structural member or portion thereof.

Figure 5A:
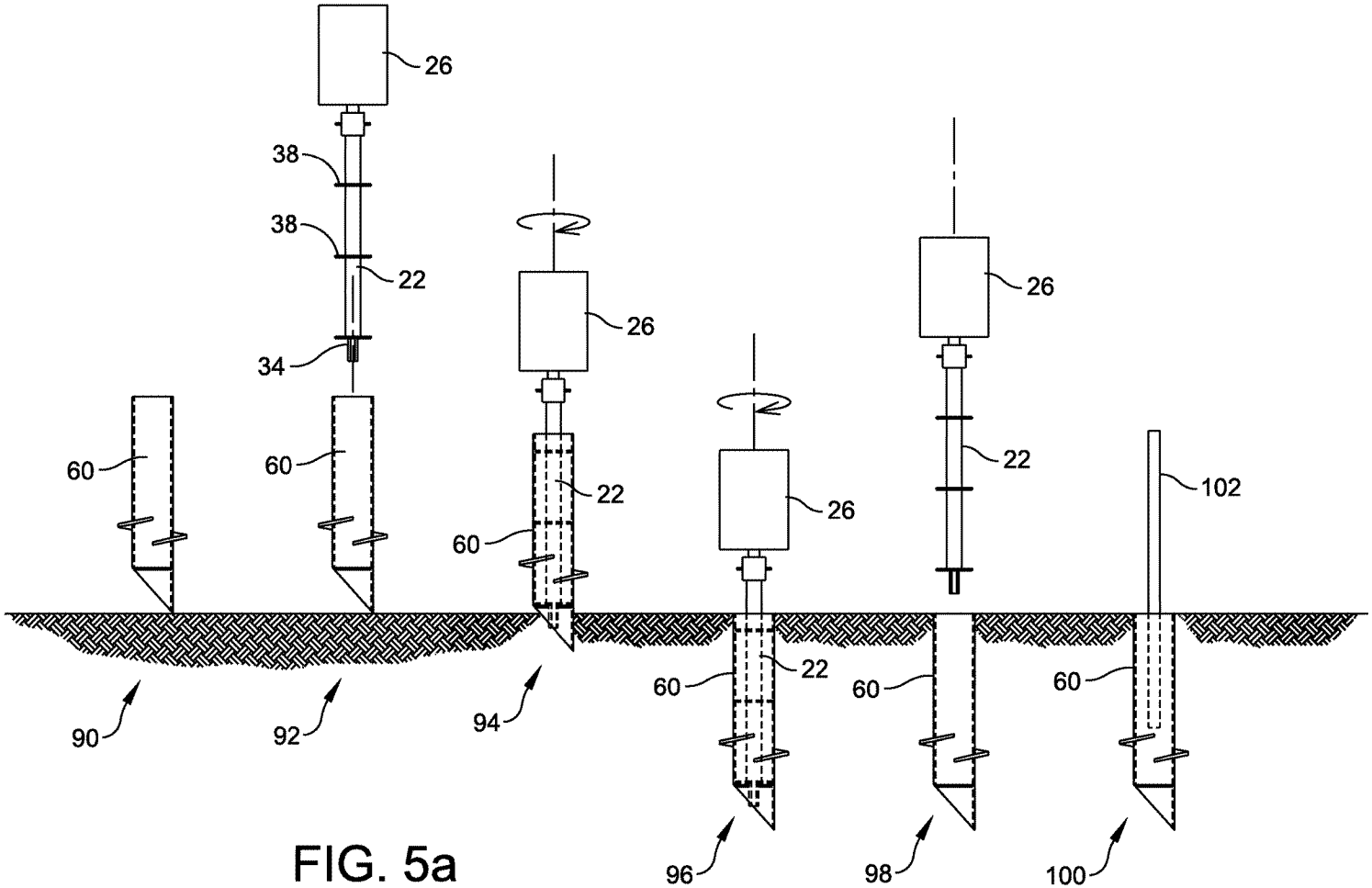
FIGS. 5*a-c* illustrate examples of a sequence of operations for installing the rotary drive tip pile member of FIG.

FIG. 5*a* illustrates an example of a sequence of operations for installing the rotary drive tip pile member 60 of FIG. 3, in accordance with one embodiment of the present invention. Operations 90-98 can be similar to operations 80-88 of FIG. 4, in one example. Because the rotary drive tip pile member 60 of this example does not have an upper pile member 42 (FIG. 2) attached thereto, at operation 100, a pile member 102 is inserted into, attached to, or fixed within the rotary drive tip pile member 60. Operation 100 may be implemented by securing a pile or other structural member 102 to support a foundation or platform or other structure—into the interior of the driving shaft 60, grouted into place, bolted or screwed into place (i.e., through the use of set screws or base plates), or welded to a cap plate that can be secured to the top of the driving shaft 60.

Figure 5C:
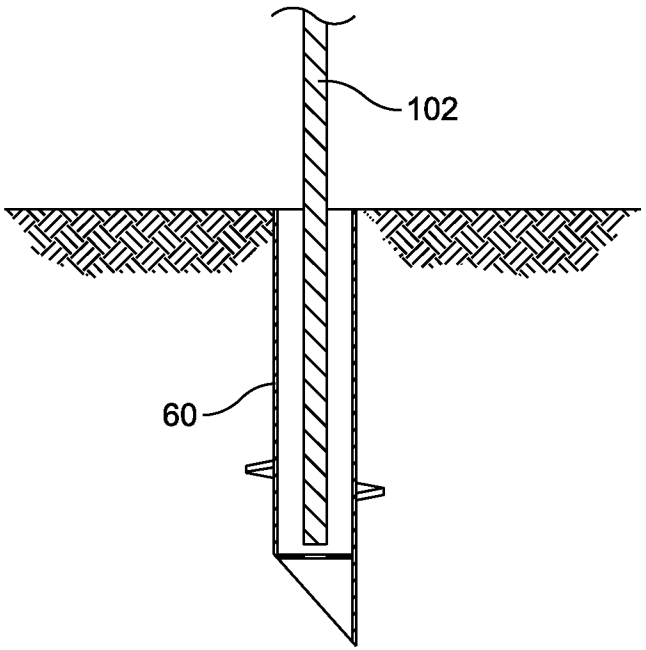
Figure 5B:
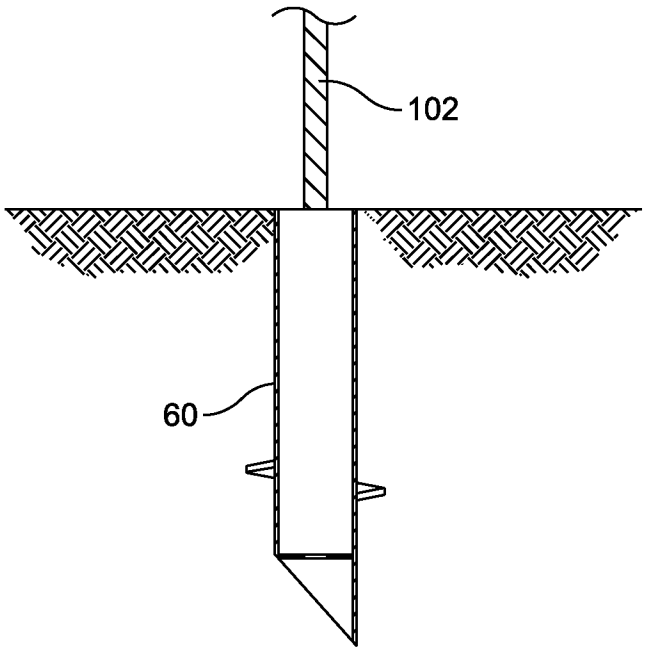

In the example of FIG. 5*a*, a pile member 102 is grouted into place within driving shaft 60; this example can be useful when a small pile diameter is being used. In the example of FIG. 5*b*, a pile member 102 is externally attached around the driving shaft 60, for instance by welding, bolts, screws, interlocking structures or other attachment techniques or combinations thereof; this example can be useful when a large pile diameter is being used. In the example of FIG. 5*c*, a pile member 102 is inserted within the driving shaft 60 and attached thereto, for instance by welding, bolts, screws, interlocking structures or other attachment techniques or combinations thereof; this example can also be useful when a large pile diameter is being used.

In another embodiment of the present invention as shown in FIG. 6, another example of a rotary drive tip pile member 24, 110 could be formed where it is driven externally, such as where a drive extension member 22, 112 is adapted to be positioned outside of and around the rotary drive tip pile member 110 and to engage a portion of the perimeter of the rotary drive tip pile member 110. FIG. 6 illustrates an example of a rotary drive tip pile member 110 driven externally. The pile member 110 may include an upper pile 118 and a lower driving shaft 120 having blades 116. The distal end of the drive extension member 112 can have one or more notches or locking mechanisms 114 adapted to engage with the blades 116 or outer perimeter of the rotary drive tip pile member 110, and hence externally drive it.

In one example of the invention, an embodiment of the invention was used where a light gauge tubular foundation support was to be driven 4-5 feet into the ground without damaging any part of the shaft (e.g., "upper shaft"). The upper shaft had pre-drilled precise holes for controls placed in the top of the upper shaft and secured with bolts. The upper shaft needed to have precise alignment, and the soil and the soil conditions consisted of very dense cobbles within silty sand. Hence, an embodiment of the invention was formed using a high grade steel pipe with helical plate attached in a fashion similar to a screw. That high grade steel pipe was attached to precut upper steel, driven intentionally by a shaft extension reaching up through the thin upper shaft with a mechanical connection between the driving tip and driving extension with all drive force between the two pieces negating any buckling of the thin wall upper shaft. The internal shaft and high grade tip were connected by a hexagonal key on the internal shaft and hexagonal receiving point in the high grade tip. Upon connection, the pile was driven without damage to the upper shaft.

Embodiments of the present invention can be used alone or in combination with an alignment system such as disclosed in co-pending U.S. patent application entitled "Alignment System and Method for Creating Holes for Piles or other Support Members" filed Jun. 25, 2012 as U.S. application Ser. No. 13/532,611, the disclosure of which is hereby incorporated by reference in its entirety.

Moreover, embodiments of this invention could be used in conjunction with a device to create pilot holes, and once the pilot holes are made in the ground, embodiments of the present invention can be inserted into the pilot holes. Examples of devices for creating pilot holes or other holes in the ground are described in U.S. patent application entitled "High Speed Precision Guide Device for Creating Holes for Piles or other Support Members", filed Jun. 25, 2012 as U.S. application Ser. No. 13/532,602, the disclosure of which is hereby incorporated by reference in its entirety. A guide device such as disclosed in the above-referenced patent application can be used to guide rotary power source such as a hydraulic drill or other conventional power source 26, and also to drive a pile member into the ground.

Hence, it can be seen that embodiments of the invention provide for the use of a drive extension member 22 (e.g., FIG. 1)—connected with a rotary power source 26 such as a hydraulic drill—to connect with and drive a rotary drive tip pile member 24 (e.g., FIG. 2 or 3) into the ground in order to support a foundation, platform, or other structure or portions thereof.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

It should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed inventions require more features than are expressly recited in each claim. Rather, as the following claims reflect, inventive aspects lie in less than all features of a single foregoing disclosed embodiment, and each embodiment described herein may contain more than one inventive feature.

While the invention has been particularly shown and described with reference to embodiments thereof, it will be understood by those skilled in the art that various other changes in the form and details may be made without departing from the spirit and scope of the invention.

The invention claimed is:

1. A system for supporting a pile member in the ground, comprising:

a first member having a first end and a second end, the first end connection to a drill, the second end having a keyed protrusion; and a second member adapted to be drilled into the ground, the second member having a hollow upper portion adapted to receive the first member therein, and a lower portion that includes at least two sets of blades along a perimeter of the lower portion, each one of the at least two sets of blades providing a load resisting mechanism though end bearing thereof, the at least two sets of blades (1) configured to hold the pile into the ground, and (2) providing sufficient support for the pile to support a structural member, without any of an external member separate from the pile, grout or fluids for ground improvement, the second member having a plate defining a keyed opening for receiving the keyed protrusion of the first member, and the hollow upper portion having a rim forming an alignment shape, and the alignment shape configured to correspond to a reciprocal feature of the pile member;

wherein the second member is adapted to be connected with the pile member in a given orientation directed by the alignment shape of the hollow upper portion.

2. The system of claim 1, wherein the first member has one or more centering rings positioned about its perimeter.

3. The system of claim 1, wherein the first member is made of steel.

4. The system of claim 1, wherein the first member is removably attachable to the drill.

5. The system of claim 1, wherein the keyed protrusion of the first member is hexagonal in shape.

6. The system of claim 1, wherein the pile member is adapted to be secured to the foundation.

7. The system of claim 1, wherein the second member is made of steel.

8. The system of claim 1, wherein the blades of the second member are helical.

9. The system of claim 1, wherein the keyed opening is positioned about a lower region of the lower portion of the second member.

10. The system of claim 1, wherein the alignment shape is a notch formed in the rim, and the notch configured to correspond to a reciprocal feature of the pile member.

11. The system of claim 1, wherein the alignment shape is a keyed shape formed in the rim, and the keyed shape configured to correspond to a reciprocal feature of the pile member.

* * * * *